US007261218B2

(12) United States Patent
Vanbeveren

(10) Patent No.: US 7,261,218 B2
(45) Date of Patent: Aug. 28, 2007

(54) COVER FOR A CONTAINER OPENING

(75) Inventor: Walter Vanbeveren, Borsbeek (BE)

(73) Assignee: ConTeyor Multibag Systems N.V. (BE)

( * ) Notice: Subject to any disclaimer, the term of this patent is extended or adjusted under 35 U.S.C. 154(b) by 123 days.

(21) Appl. No.: 10/889,283

(22) Filed: Jul. 12, 2004

(65) Prior Publication Data

US 2005/0012005 A1 Jan. 20, 2005

(30) Foreign Application Priority Data

Jul. 17, 2003 (DE) ..... 203 10 990 U

(51) Int. Cl.
*B65D 43/20* (2006.01)

(52) U.S. Cl. ..... 220/350; 160/23.1

(58) Field of Classification Search ..... 160/313, 160/319, 320; 220/350, 345.1; 292/336.2
See application file for complete search history.

(56) References Cited

U.S. PATENT DOCUMENTS 2,089,876 A * 8/1937 Cavedo ..... 160/290.1
2,847,064 A * 8/1958 Roth ..... 160/267.1
3,180,401 A * 4/1965 Gambon et al. ..... 160/265
4,369,829 A * 1/1983 Casiday ..... 160/120

* cited by examiner

*Primary Examiner*—Blair M. Johnson
(74) *Attorney, Agent, or Firm*—Stevens & Showalter LLP

(57) ABSTRACT

The present invention relates to a cover for a container opening (1) having a flexible web (3) one end of which is movable from a first edge of the opening (1) towards a second edge of the opening (1) in order to close the opening by means of the web (3), wherein the web (3) is lockable in at least one position covering the container opening in whole or in part and wherein the first end of a flexible pulling element (5) is fastened to the first end of the flexible web movable over the opening.

Figure 1:
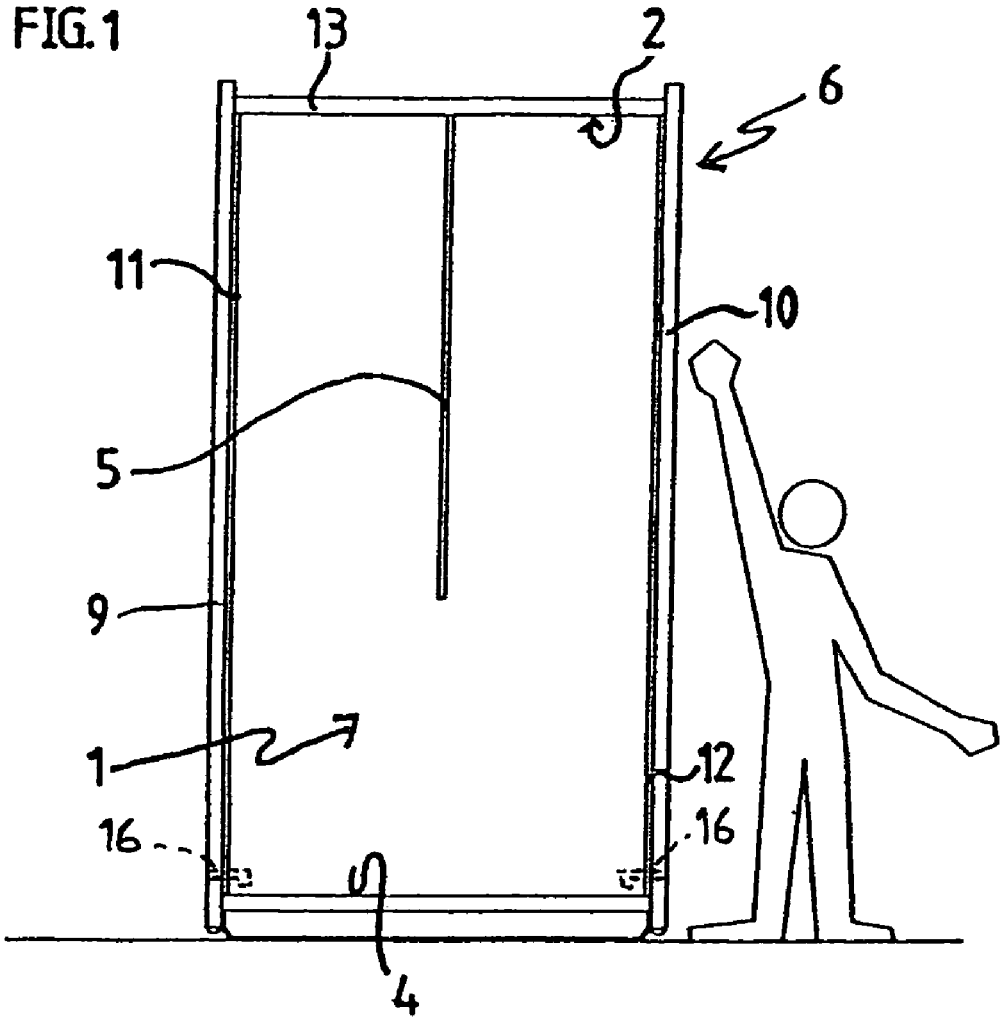

In order to provide a pulling element for a cover opening which allows closing of the container opening it is provided according to the invention that the pulling element is fastened by its second end to the container (6) at or in proximity to that edge of the container opening (1) which is closest to the first end of the flexible web in the open state.

14 Claims, 1 Drawing Sheet

COVER FOR A CONTAINER OPENING

This application claims priority to German Patent Application 203 10 990.2, filed Jul. 17, 2003.

The present invention relates to a cover for a container opening having a flexible web, one end of which is movable from a first edge of the opening towards a second edge of the opening in order to close the opening by the web, wherein the web is lockable in at least one position covering the container opening in whole or in part and wherein at the first end of the flexible web movable over the opening the first end of a flexible pulling element is fastened.

The state of the art discloses covers for container openings, eg transport containers for the most varied components used in the automotive industry, in which a flexible web composed of plastic material, for example, is stretched to form a curtain in front of the container opening, wherein the articles to be transported are accommodated in individual compartments of the container which are also mostly formed of flexible fabric or plastic webs. In order to allow easy opening and closing of the container opening the second end of the flexible web is generally fastened in the manner of a blind to a rotatable roller so that the remainder of the flexible web can be wound up on the roller. In doing so the roller is usually arranged at the upper end of the container opening. In recent times common transport containers have become ever higher in order better to use the available space in transport lorries without stacking the containers on top of one another and to allow easy loading by means of fork-lift trucks or lifting trucks. The rollers and the free first ends of the flexible webs in the wound-up state may then be located at a height above the container floor which can no longer be reached by persons of normal height even with outstretched arms.

In order to enable easy unrolling the state of the art discloses vertically movable covers in which one end of a pulling element is fastened to the first, lower end of the flexible web as is also known from conventional window blinds. In this case the term pulling element is used below for loops, strings or sections of web which emanate or hang down from one end of the flexible web and are all suitable for pulling the flexible web downwards or generally across the container opening.

At least in the case of openings reaching to just above the floor these pulling elements disclosed in the state of the art have the disadvantage that after sealing the container opening by the flexible web they are in contact with the ground or the floor of the container so that they are subjected to correspondingly high soiling and increased wear.

By comparison with this state of the art the present invention has the aim of providing a pulling element for a cover for a container opening which allows closing of the container opening without said disadvantages.

This task is solved by the device according to the invention in that a cover for a container opening having the characteristics identified at the outset is provided in which the pulling element is fastened by its first end to the end of the flexible web movable across the opening and by its second end to the container at or in proximity to that edge of the container opening located closest to the first end of the flexible web in the open state.

Without any intention of restriction, particular refinements and advantages of the device according to the invention are discussed below with reference to examples in which the cover is moved across a side opening of a container substantially in the vertical direction. A corresponding generalisation of the terms "top" and "bottom" to "right" and "left" or "front" and "back" is obvious to persons skilled in the art.

Such a device is advantageous since it avoids an excessive length of the pulling element and, in the case of a vertical opening, prevents the second end of the pulling element coming to rest on the ground or the floor of the container.

A useful embodiment of the invention is one in which the second end of the flexible web is fastened to a rotatable roller, wherein the flexible web can be wound onto the roller. In this way it is prevented when the container opening is open during loading and unloading that the flexible web comes into the working area and is damaged.

Alternatively, however, the second end of the flexible web could also be guided and pulled upwards and rearwards by means of a pulling device along the upper side of the container and downwards along the rear side thereof in order to pull the first end of the web in the opening direction. An embodiment of the invention is preferred in which the pulling element is a strap of a flexible web or, as an alternative thereto, a string.

Particularly preferred is an embodiment in which the pulling element substantially has a length matching the width of the container opening (in the direction of movement of the cover) for a vertical, movable cover, that is the spacing of the upper edge relative to the lower edge of the container opening. When the flexible web is completely wound up the pulling element hangs down to approximately half the height of the container opening. Even when the container opening is completely closed by the flexible web, at this length the pulling element does not rest on the floor of the container or on the ground and, accordingly, is not subject to soiling or a high degree of wear.

Usefully, the second end of the pulling element is fastened to the inside of the container. Thus, when the container opening is completely closed it runs in the inner region of the container and, for example, cannot be damaged or tom during loading or unloading of the container.

An advantageous refinement of the invention is one in which the roller is pretensioned by a torsion spring so that the flexible web can be wound up under the drive of a spring. In this embodiment the web must be pulled down against the force of the spring, but in return, however, the web is wound onto the roller driven by the spring as soon as the web or the pulling element is released. In doing so it is advantageous for at least one locking mechanism to be provided on the container by means of which the web, preferably the first end of the flexible web, is fixable. If the flexible web is pulled down against the force of the torsion spring it would snap up again without a locking mechanism. The locking mechanism holds the web in a closed state so that the web extends taut in front of the container opening.

A preferred embodiment of the invention is one in which a substantially rigid or flexible rod is fitted on the first end of the flexible web parallel to the lower edge of the web. This rod stretches the flexible web uniformly when tension is applied to the pulling element. In doing this it is useful for the locking mechanism to be constructed in such a way that it is formed by hook-shaped receptacles on each side of the container opening by means of which the rod can be brought into engagement with the first end of the flexible web. After the web has been pulled down only the two ends of the rod at the lower end of the flexible web need be brought into engagement with the two hooks in order to close the container opening.

To ensure the best possible covering of the container opening an embodiment of the invention is advantageous in which on each side of the container opening a lateral guide is provided in which the flexible web or elements fastened to it are guided. The lateral guides prevent penetration of dirt or moisture at the sides of the container opening into the interior of the container. Furthermore, this prevents articles falling out of the container during transport.

Figure 2:
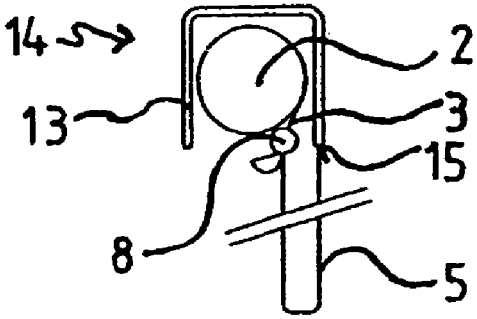

Other characteristics, advantages and applications of the present invention are made clear by the embodiment and associated figures described by way of example below. These show:

FIG. 1 a view from the front of the cover according to the invention for a container opening;

FIG. 2 a side view in section of the cover according to the invention for a container opening.

FIG. 1 shows a view from the front of a container 6. The container opening 1 in FIG. 1 is shown in the open state and extends in this embodiment across the entire open height of the container from its floor 4 to the upper edge of the container or the roller 2 fitted there. Provided on the side walls 9, 10 of the container 6 in the region of the container opening 1 are lateral guides 11, 12 which serve to stabilise the cover. In the embodiment shown the edge guides 11, 12 are formed by steel bars. Alternatively, however, the edges of the web 3 may also be guided by wire cables or in guide grooves.

In the embodiment shown the cover consists of a flexible web material which is strong enough to afford an effective cover for the container against dirt and moisture while it is flexible enough to be wound round a roller 2 arranged in the upper region of the container opening 1.

As can be seen in FIG. 2 a rod 8 or bar is fastened to the lower free end of the cover 3 which rod extends over the entire width of the cover and projects a little beyond this in order to engage in the lateral guides 11, 12 so that on pulling the cover down the bar is guided by the lateral guides in order to stabilise the flexible web 3 of the cover.

In the embodiment shown the rotatable roller 2 is arranged in a U-shaped covering profile 13 which protects the roller and the flexible web 3 wound thereon from damage. If the flexible web 3 is in the wound-up state and, as shown in the illustrated embodiment, the container 6 is higher than the natural reach of a human arm the cover 3 must be pulled down with the aid of a pulling element 5 fastened to the rod 8 attached to the lower end of the cover 3. In the embodiment shown the pulling element 5 according to the invention consists of a strip of the same flexible web material as the cover 3. In this case the pulling element hangs down far enough so that it comes within reach of a human arm. This can be seen clearly in FIG. 1. In order to prevent that on pulling down the cover 3 the pulling element 5 reaches the ground or the bottom 4 of the container 6 the pulling element is fastened as shown schematically in FIG. 2 to a point 15 on the inside of the profile 13 surrounding the roller 2. If, as shown in the exemplified embodiment, the length of the pulling element 5 has approximately the size of the spacing of the lower edge of the roller 2 relative to the floor 4 of the container 6 or to the lower edge of the opening the flexible web 3 can be pulled down to the floor 4 of the container 6 without the pulling element 5 ever touching the floor 4 of the container 6. Accordingly, it is protected from dirt on the floor 4 or ground in front of the container 6. In this case it is important that the second end of the pulling element 5 is fastened to the inside of the container 6 in proximity to the upper edge of the opening, to the profile 13 covering the roller in the embodiment shown, and in fact inside the flexible web with respect to the container. Thus, the pulling element 5 does not hang down on the outside 14 of the container 6. This is particularly advantageous during transport of the container with the container opening 1 closed since a pulling element fitted on the outside at the upper edge of the container 6 would also hang down on the outside of the cover and be easily torn off which could damage the cover.

The roller 2 readily identifiable in FIG. 2 is pretensioned with the aid of a torsion spring so that the flexible web 3 is rolled up automatically if it is not pulled down or fixed in a pulled-down position. For that reason devices are provided on both sides 9, 10 of the container in the lower region of the container opening 1 in proximity to the floor 4 of the container 6 which fix the rod 8 when the latter is brought into engagement with the retaining devices 16. In the embodiment shown there are hook-shaped receptacles on each of the two sides 9, 10 of the container 6 with which the rod 8 can be brought into engagement.

The invention claimed is:

1. Cover in combination with a container including a container opening, the cover (1) having a flexible web (3), one end of which is movable from a first edge of the opening (1) towards a second edge of the opening (1) in order to close the opening by the web (3), wherein the web (3) is lockable in at least one position covering the container opening and wherein at the first end of the flexible web movable across the opening the first end of a flexible pulling element (5) is fastened, characterised in that the pulling element is fastened by its second end to a stationary location relative to the container (6) at or in proximity to that edge of the container opening (1) located closest to the first end of the flexible web in the open state, and characterised in that the pulling element is substantially as long as the distance between its fastening point to the container and the second edge of the opening.

2. Cover according to claim 1, characterised in that the first end of the flexible web (3) is fastened to a rotatable roller (2), wherein the flexible web (3) can be wound onto the roller.

3. Cover according to claim 1 or 2, characterised in that the pulling element (5) is a strap of a flexible web.

4. Cover according to claim 1 or 2, characterised in that the pulling element (5) is a string.

5. Cover according to claim 1, characterised in that the second end of the pulling element (5) is fastened on the inside of the container.

6. Cover according to claim 2, characterised in that the roller (2) is pretensioned by a torsion spring in such a way that the flexible web (3) can be wound up driven by a spring.

7. Cover according to claim 1, characterised in that at least one locking mechanism is provided on the container (6) by means of which the first end of the flexible web (3) is fixable.

8. Cover according to one of claims 1, 2, 5, 6 or 7, characterised in that a substantially rigid or flexible rod (8) parallel to the edge of the web (3) is fitted to the first end of the flexible web (3).

9. Cover according to claim 8, characterised in that at least one hook-shaped receptacle is provided on the container (6) on each side (9, 10) of the container opening (1) by means of which receptacle the rod (8) can be brought into engagement with the first end of the flexible web (3).

10. Cover according to one of claims 1, 2, 5, 6, or 7, characterised in that on each side (9, 10) of the container opening (1) a lateral guide (11, 12) is provided in each ease in which the flexible web (3) or the elements (8) fastened thereto are guided.

11. A cover in combination with a container including an opening having opposing upper and lower edges, the cover comprising:

a flexible web having first and second ends, the first end being movable from the upper edge of the opening, at an open state of the opening, towards the lower edge of the opening, at a closed state of the opening;

a flexible pulling element having first and second ends, the first end of the pulling element being fastened to the first end of the flexible web; and characterized in that the second end of the pulling element is fastened to a stationary location relative to the container adjacent the upper edge of the opening, and characterized in that the pulling element is substantially as long as the distance between its fastening point to the container and the lower edge of the opening.

12. The cover according to claim 11, characterised in that the first end of the flexible web is fastened to a rotatable roller, wherein the flexible web can be wound onto the roller.

13. The cover according to claim 11, characterised in that the second end of the pulling element is fastened on the inside of the container, and the pulling element is located on a side of the flexible web facing inwardly into the container when the first end of the flexible web is positioned adjacent the lower edge of the opening to form the closed state of the opening.

14. The cover according to claim 11 characterised in that, when the first end of the flexible web is adjacent the upper edge of the opening, at the open state of the container, the pulling element extends from its fastening point to the container approximately halfway to the lower edge of the opening.

* * * * *

UNITED STATES PATENT AND TRADEMARK OFFICE

CERTIFICATE OF CORRECTION

PATENT NO. : 7,261,218 B2
APPLICATION NO. : 10/889283
DATED : August 28, 2007
INVENTOR(S) : Walter Vanbeveren It is certified that error appears in the above-identified patent and that said Letters Patent is hereby corrected as shown below:

In the Specification:

Col. 1, line 14, “eg transport containers” should read --e.g. transport containers--;

In the claims:

Col. 4, line 65, “is provided in each ease” should read --is provided in each case--.

Signed and Sealed this

Twenty-fifth Day of December, 2007

JON W. DUDAS
*Director of the United States Patent and Trademark Office*